US005982269A

United States Patent [19]

Sorenson

[11] Patent Number: 5,982,269

[45] Date of Patent: Nov. 9, 1999

[54] ELECTRIC SWITCH AND THERMAL PROTECTOR

[76] Inventor: Richard W. Sorenson, 6540 South East Harbor Circle, Stuart, Fla. 34996

[21] Appl. No.: 08/663,705

[22] Filed: Jun. 14, 1996

[51] Int. Cl.[6] ..... H01H 37/04; H01H 37/52

[52] U.S. Cl. ..... 337/380; 337/333; 337/362; 337/365; 200/553

[58] Field of Search ..... 337/36, 37, 51, 337/58, 59, 333, 334, 342, 343, 345, 362, 365; 200/553

[56] References Cited

U.S. PATENT DOCUMENTS

| | | | |
|---|---|---|---|
| 3,311,725 | 3/1967 | Butler et al. | 337/343 |
| 3,919,679 | 11/1975 | Kingma | 397/102 |
| 4,258,349 | 3/1981 | Flory | 337/46 |
| 4,363,016 | 12/1982 | Unger | 337/91 |
| 4,628,295 | 12/1986 | Yasuda et al. | 337/354 |
| 4,791,397 | 12/1988 | Wells | 337/354 |
| 4,931,762 | 6/1990 | Fierro | 337/66 |
| 4,937,548 | 6/1990 | Sdunek | 337/70 |
| 5,089,799 | 2/1992 | Sorenson | 337/68 |
| 5,264,817 | 11/1993 | Sorenson | 337/68 |

*Primary Examiner*—Leo P. Picard
*Assistant Examiner*—Jayprakash N. Gandi
*Attorney, Agent, or Firm*—McCormick, Paulding & Huber LLP

[57] ABSTRACT

A switch with a cantilevered leaf spring as the movable bi-metal contact lever can be switched "ON" or "OFF" by a rocker pivoted in the housing. No lost motion plunger is required and no centor terminal is provided in the housing bottom wall. The contact lever also has a temperature sensitive shape so it will bend upwardly toward the rocker to open the switch contacts in response to an overcurrent condition. The rocker is returned to "OFF" by such a shape change in the bi-metal contact lever.

8 Claims, 3 Drawing Sheets

"ON" POSITION

"OFF" POSITION

ELECTRIC SWITCH AND THERMAL PROTECTOR

BACKGROUND OF THE INVENTION (1) Field of the Invention

The present invention relates to thermal circuit protector devices which also function as "ON"/"OFF" switches, and deals more particularly with a simplified version for a thermal circuit protector/switch that provides an inexpensive substitute for more complex devices of this type.

(2) Description of the Prior Art

Switches for use as either a thermal circuit protector or switch are known. For example, snap action bi-metallic elements have been provided for use in connection with thermal protectors of the type designed to provide a flag or insulative device between the contacts of the switch in response to an overload condition sensed by the bi-metallic element. See for example, U.S. Pat. Nos. 5,089,799 and 5,264,817 for examples of thermal protective switches of the type utilizing such a flag. Other thermal protective devices that serve a switch function operate as a result of a push button action, and require that the push button be pulled back out in order to turn the device off. Butler, U.S. Pat. No. 3,311,725 illustrates a circuit breaker/switch of this general type.

Still other thermostatic switches have a snap action disc that can be reset by a push button (See U.S. Pat. Nos. 4,791,397 and 4,628,295 for examples of such a device).

Although, much more complicated, and therefor expensive to manufacture, thermal circuit breakers are known also (See U.S. Pat. Nos. 4,931,762; 4,937,548 and 4,258,349).

The general purpose of the present invention is to provide a thermal switch/breaker that does not require a flag, and which can be operated as, and give the appearance of being, a conventional rocker switch, and wherein the device is also capable of "trip free" operation so that even if held in the "ON" position, will not result in sustained closing of the contacts.

SUMMARY OF THE INVENTION

In accordance with the present invention, an upwardly open hollow housing is provided with a bottom wall and defines a top opening for pivotably receiving a rocker/actuator. The actuator includes a depending post which need not be provided with a spring loaded plunger as is the case with a conventional rocker switch. Rather, the lower end of the post projects inside the housing for directly engaging a movable contact lever.

The movable contact lever has a free end which is provided with a movable switch contact, and the contact lever is biased toward a position such that the movable contact is normally spaced from a fixed contact. The actuator post end portion acts on this movable contact lever to hold it in engagement with the fixed contact in the "ON" position. The movable contact lever is defined at least in part by a bi-metallic element which exhibits a thermally responsive change in shape or curvature such that the movable contact moves away from the fixed contact in response to a predetermined temperature rise of the bi-metallic element.

The movable rocker/actuator also includes a portion that is spaced from the depending post, and which also engages the movable contact lever adjacent the free end thereof to define a stop for the contact lever in an overheat/overcurrent condition.

The rocker is adapted to be moved to its "OFF" position as a result of such contact between one end of the rocker and the free end portion of the contact lever. If the rocker is held in the "ON" position, the contact will open during overload. After the bi-metal contact lever cools off, the contacts will reclose. However, as soon as an overcurrent condition is sensed once again, the contacts will reopen.

In the preferred embodiment, the movable contact lever has a medial portion between its free end and its other end which is opposite the free end and is secured to one of the switch terminals. This medial portion defines an abutment for engagement with the end of the actuator post to provide a stable switch "ON" position at least in the absence of a thermal overheat condition in the bi-metallic element.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views.

DETAILED DESCRIPTION OF PREFERRED EMBODIMENT

Figure 1:
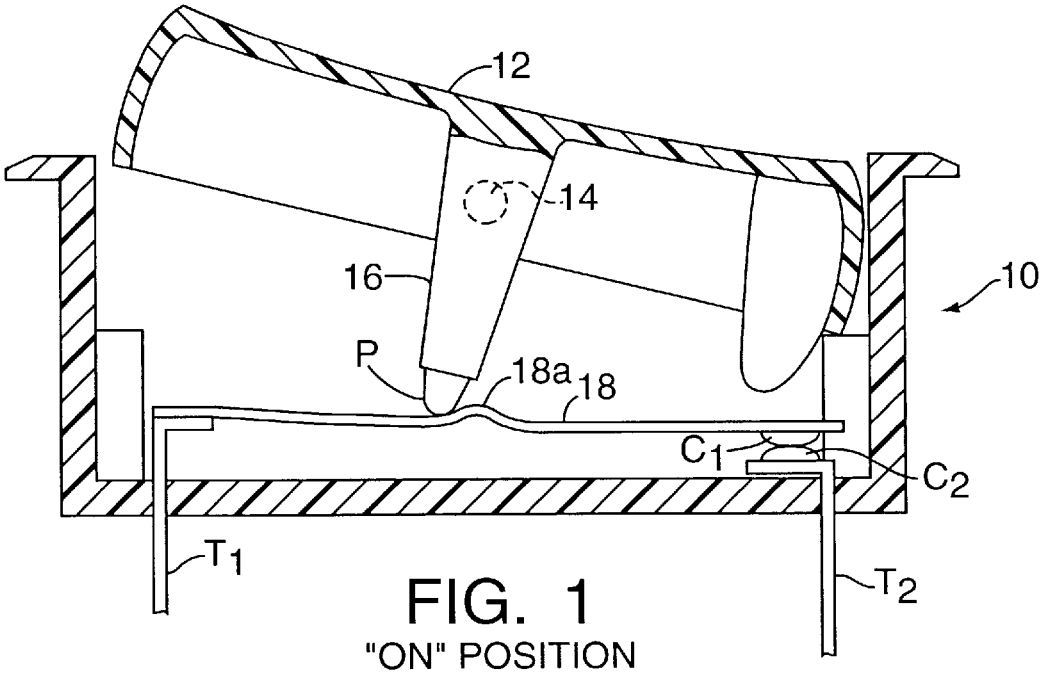
FIG. 1 shows in vertical section a preferred form of thermal switch and circuit protector of the invention, the rocker/actuator being in the "OFF" position, as is the movable contact lever.
Figure 1A:
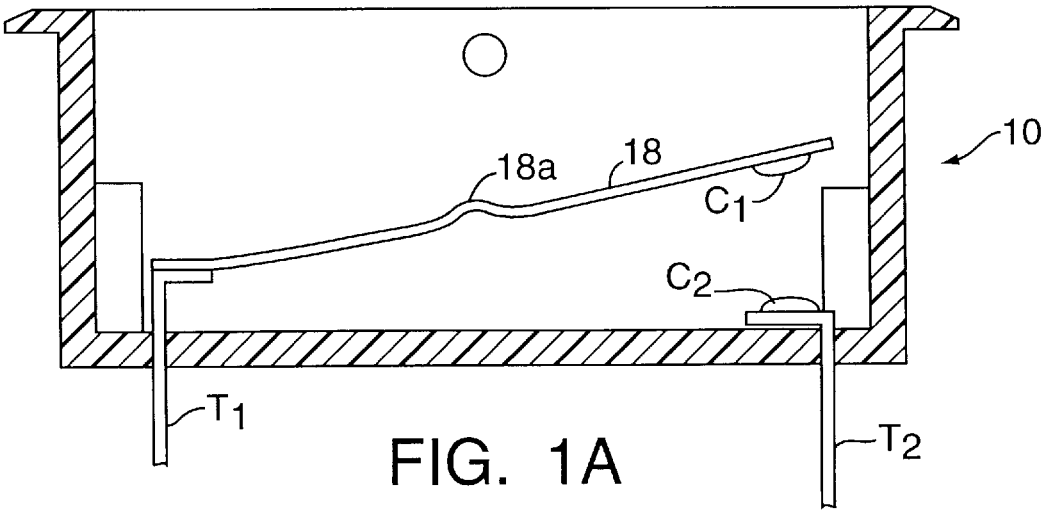
FIG. 1A is a view of the same switch illustrated in FIG. 1, but with the rocker removed so that the movable contact lever assumes a neutral position as a result of not being acted on by the depending post of the rocker/actuator.

Referring now to the drawings in greater detail, FIG. 1 shows a housing 10 of the type having a generally rectangular upwardly-open cavity containing the various components of the switch. A pivotably mounted rocker/actuator 12 is provided with laterally extending axle defining projections on either side as indicated generally at 14, which projections are received in openings (not shown) provided for this purpose in the housing side walls. As so supported, the rocker/actuator is adapted to pivot from the "ON" position shown in FIG. 1 to the "OFF" position illustrated in FIG. 2.

The actuator 12 includes a depending post 16 which is preferably formed integrally with the rocker/actuator, and which is, therefore, unlike a conventional post in a conventional rocker switch where the lower end of the post comprises a spring loaded plunger. Thus, in a prior art rocker switch, the spring loaded plunger provided in place of the integral post 16 serves as a lost motion device between the movable contact lever and the rocker axis, which is fixed in the housing and defined by the axle portions 14. Such lost motion is required in the conventional rocker switch as a result of the fact of the movable contact lever is generally pivotably mounted for movement about an axis defined at the upper end of a center terminal on a fixed fulcrum defined in the housing.

Figure 2:
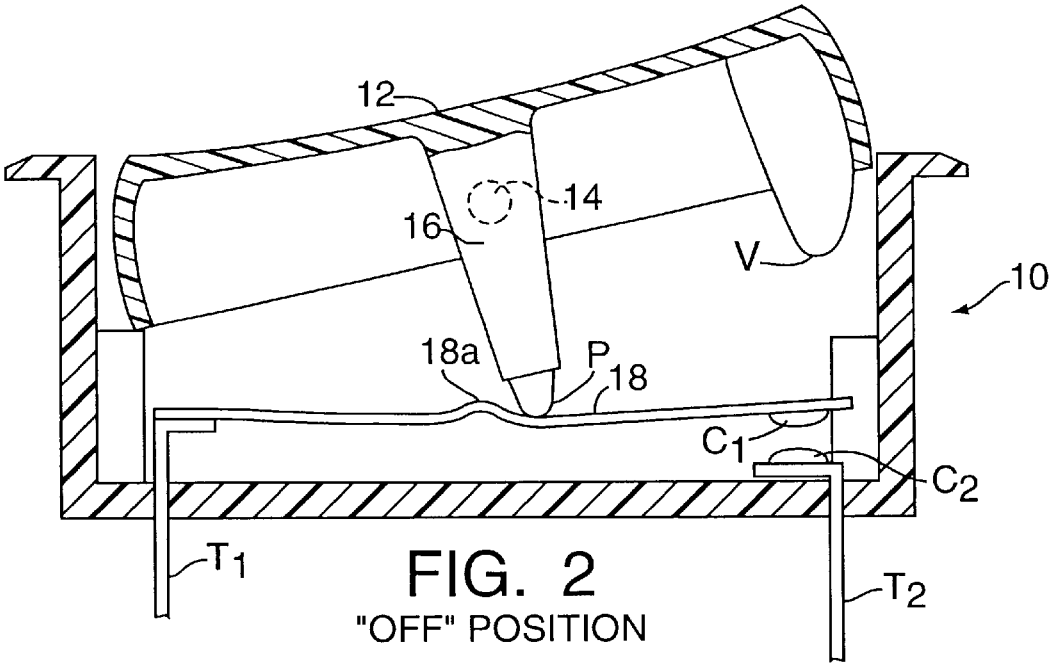
FIG. 2 is a vertical section similar to FIG. 1, but illustrating the rocker/actuator and movable contact lever in their "ON" positions.

The lower end of the post 16, which is indicated generally at P in the drawings, is adapted to engage a movable contact lever 18 so as to move the contact lever between the positions shown for it in FIGS. 1 and 2 as a result of movement of the rocker between the positions shown for the rocker in FIGS. 1 and 2.

The free end of the contact lever 18 includes a first contact $C_1$ that is adapted to engage a fixed contact $C_2$ provided for this purpose on the terminal $T_2$ that is mounted on the bottom wall of the housing for this purpose.

Another terminal $T_1$ is provided at the opposite end of the housing, and supports the opposite end of the movable contact lever. The movable contact lever 18 may be brazed or otherwise secured to the terminal $T_1$ with the result that the contact lever 18 comprises a cantilever beam which is acted on by the end portion P of post 16 of the rocker 12 as described above to define the "OFF" and "ON" positions of the lever shown in FIGS. 1 and 2.

The movable contact lever 18 includes a raised rib portion 18*a* for engagement with the end portion P of the post 16. This raised portion 18*a* that provides a degree of resistance for the rotation of the rocker 12, and serves to define a positive "ON" and positive "OFF" position for the rocker as shown in FIGS. 1 and 2.

In accordance with the present invention, the movable contact lever 18 comprises a bi-metallic element, one end of which is joined to the upper end of terminal $T_1$ as described above, and the other end of which comprises the free end portion of the lever 18 carrying the movable contact $C_1$. Such a bi-metallic element is fabricated from separate mutually interactive metallic plates of different coefficients of thermal expansion and predetermined electrical resistivity so that when the bi-metallic element senses an overcurrent condition, as suggested in FIG. 4, the heating effect of such an overcurrent condition will cause the bi-metallic lever 18 to assume a more curved configuration that is quite different from the generally flat configuration illustrated in FIGS. 1 and 2.

Figure 4:
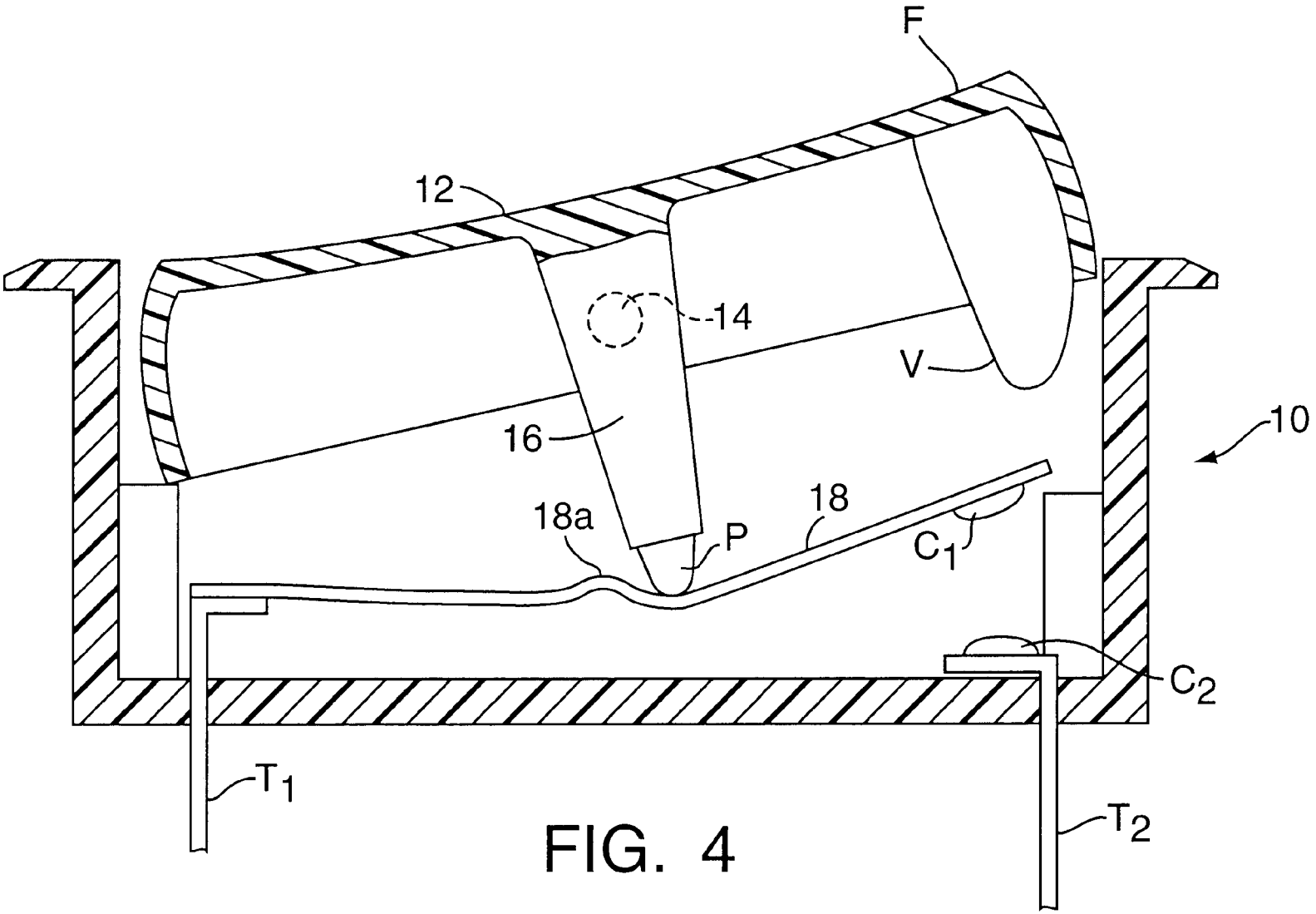
FIG. 4 is a view similar to FIGS. 1, 2 and 3 but illustrating the movable contact lever still in a deformed condition per FIG. 3, and with the rocker/actuator biased to an "OFF" position as a result of the force exerted by the movable contact lever.

As the free end of lever 18 bows upwardly, it will engage abutment V on rocker 12 to move rocker 12 to the FIG. 4 or "OFF" position, absent any force applied at F.

Figure 3:
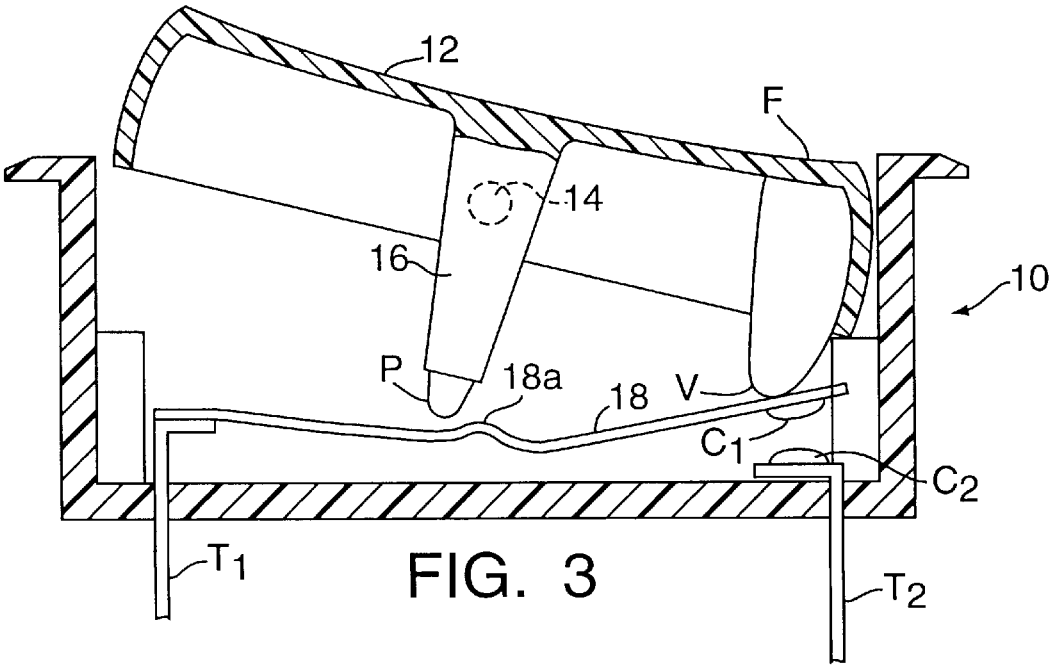
FIG. 3 is a view similar to FIG. 2 but illustrating the movable contact lever in a deformed condition such as would occur during an overcurrent condition if the rocker/actuator were held in the rocker "ON" position.

FIG. 3 also illustrates such an overheated condition for the contact lever 18 as illustrated in FIG. 4, but with the rocker 12 held in its "ON" position by a force F. In this situation, the contacts $C_1$ and $C_2$ would remain open as long as the bi-metallic element or lever has not cooled down. Thus, in the event that the rocker 12 is held in the "ON" position as shown in FIG. 4, the bi-metallic element can cool down so as to assume the position shown for it in FIG. 2 with the result that the contacts can then reclose. If the rocker is held down while the overcurrent condition persists, the contacts will again reopen as suggested in FIG. 3. Thus, despite the fact that the rocker is held in the FIG. 4 position, the contacts will cycle "ON" then "OFF" until the overcurrent condition is corrected.

In conclusion, the contact lever 18 not only serves to sense any overcurrent condition in a circuit that includes the above-described device, but the unique lever 18 also serves as a biasing means to urge the rocker 12 toward its "OFF" position in such an overcurrent condition. Then functions are achieved in this unique device such that the lever 18 also opens and closes the movable contact in response to rocker/actuator movement in a conventional switching mode.

I claim:

1. An electric switch and thermal circuit protector comprising:

a hollow housing having a bottom wall and defining a top opening, fixed and movable switch contacts normally spaced from one another inside said hollow housing, first and second switch terminals projecting from said housing bottom wall, an acutuator movably mounted in said housing, said actuator including a depending post, and said post having an end portion movable between "ON" and "OFF" positions as said actuator is so moved, a movable contact lever connected to said first terminal and having a free end portion supporting said movable switch contact, said moveable contact lever having an end portion fixed to said first terminal to provide a cantilever action for said moveable contact lever, said movable contact lever having flat configuration, and being acted upon said actuator post end portion to close said fixed and movable contacts in said flat configuration when said actuator is in said "ON" position, and said movable contact lever being defined at least in part by a bi-metallic element that changes in shape from its generally flat configuration to a curved configuration in response to an increase in temperature, said curved configuration resulting in said movable contact moving away from said fixed contact in response to a predetermined temperature rise of said bi-metallic element.

2. The switch and thermal circuit protector of claim 1, wherein said actuator can be manually held in its "ON" position, thereby moving said post toward its "ON" position while said free end portion of said movable contact lever remains spaced from said fixed contact as a result of said bi-metallic element assuming said curved configuration in response to a temperature rise, thereby providing a "trip free" condition for said switch circuit protector.

3. The switch and thermal circuit protector of claim 1, wherein said movable contact lever has a medial portion defining an abutment that is engaged by said post end portion holding said movable contact lever in a position creating engagement between the fixed and the movable contact and thereby defining a switch "ON" condition.

4. The switch and circuit protector of claim 1, wherein said actuator includes a depending abutment portion spaced from said post portion for engaging the free end portion of said movable contact lever and defining a stop therefore when the actuator is held in its "ON" position and when the bi-metallic contact lever has assumed a curved configuration in response to an overheat condition.

5. An electric switch and thermal circuit protector comprising:

a hollow housing having a bottom wall and defining a top opening, fixed and movable switch contacts normally spaced from one another inside said hollow housing, first and second switch terminals projecting from said housing bottom wall, an actuator movably mounted in said housing, said actuator including a depending post, and said post having an end portion movable between "ON" and "OFF" positions as said actuator is so moved, said actuator further including a depending abutment portion spaced from said depending portion, a movable contact lever connected to said first terminal and having a free end portion supporting said movable switch contact, said movable contact lever normally having a generally flat configuration, and being acted upon by said actuator post end portion to close said fixed and movable contacts in said flat configuration when said actuator is in said "ON" position, and said movable contact lever being defined at least in part by a bi-metallic element that changes in shape from its generally flat configuration to a curved configuration in response to an increase in temperature, said curved configuration resulting in said movable contact moving away from said fixed contact in response to a predetermined temperature rise of said by-metallic element said depending abutment portion being engageable with the free end portion of said moveable contact lever to define a stop when the actuator is held in its ON position such that the bi-metallic contact lever has a curved configuration in response to an overheat condition.

6. The switch and thermal circuit protector of claim 5, wherein said actuator can be manually held in its "ON" position, thereby moving said post toward its "ON" position while said free end portion of said movable contact lever remains spaced from said fixed contact as a result of said by-metallic element assuming said curved configuration in response to a temperature rise, thereby providing a "trip free" condition for said switch circuit protector.

7. The switch and thermal circuit protector of claim 5, wherein said movable contact lever has a medial portion defining an abutment that is engaged by said post end portion to normally hold said movable contact lever in a position creating engagement between the fixed and the movable contact and thereby defining a switch "ON" condition.

8. The switch and thermal circuit protector of claim 5, wherein said movable contact lever has a portion fixed to said first terminal to provide a cantilever action for said movable contact lever.

* * * * *